US009593551B2

(12) United States Patent
Corre et al.

(10) Patent No.: US 9,593,551 B2
(45) Date of Patent: Mar. 14, 2017

(54) PERFORATING PACKER SAMPLING APPARATUS AND METHODS

(71) Applicant: Schlumberger Technology Corporation, Sugar Land, TX (US)

(72) Inventors: Pierre-Yves Corre, Eu (FR); Stephane Metayer, Abbeville (FR); Jean-Louis Pessin, Paris (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 553 days.

(21) Appl. No.: 14/136,798

(22) Filed: Dec. 20, 2013

(65) Prior Publication Data

US 2015/0176406 A1 Jun. 25, 2015

(51) Int. Cl.

| | |
|---|---|
| ***E21B 33/12*** | (2006.01) |
| ***E21B 43/1185*** | (2006.01) |
| ***E21B 49/08*** | (2006.01) |
| ***E21B 33/124*** | (2006.01) |

(52) U.S. Cl.

CPC ..... *E21B 33/1208* (2013.01); *E21B 33/1243* (2013.01); *E21B 43/11855* (2013.01); *E21B 49/088* (2013.01)

(58) Field of Classification Search

CPC ..... E21B 33/1208; E21B 43/11855; E21B 49/088; E21B 43/116; E21B 33/1243; E21B 43/117

See application file for complete search history.

(56) References Cited

U.S. PATENT DOCUMENTS

| | | | | |
|---|---|---|---|---|
| 2,441,894 | A | 5/1948 | Mennecier | |
| 2,690,123 | A | 9/1954 | Kanady et al. | |
| 3,181,608 | A | 5/1965 | Palmer | |
| 6,988,557 | B2 * | 1/2006 | Whanger | E21B 33/127 166/207 |
| 7,665,356 | B2 | 2/2010 | Ramakrishan et al. | |
| 7,699,124 | B2 | 4/2010 | Corre et al. | |
| 7,753,118 | B2 | 7/2010 | Ramakrishnan et al. | |
| 7,753,121 | B2 | 7/2010 | Whitsitt et al. | |
| 7,757,769 | B2 | 7/2010 | Hill et al. | |
| 7,775,279 | B2 | 8/2010 | Marya et al. | |
| 7,921,714 | B2 | 4/2011 | Duguid et al. | |
| 7,984,761 | B2 | 7/2011 | Chang et al. | |
| 7,997,353 | B2 | 8/2011 | Ochoa | |
| 8,091,634 | B2 | 1/2012 | Corre et al. | |
| 8,162,052 | B2 | 4/2012 | Goodwin et al. | |
| 8,794,335 | B2 | 8/2014 | Fadul et al. | |
| 9,181,771 | B2 * | 11/2015 | Corre | E21B 33/127 |
| 2007/0151724 | A1 * | 7/2007 | Ohmer | E21B 33/1208 166/187 |

(Continued)

OTHER PUBLICATIONS

Office Action issued in U.S. Appl. No. 14/136,364, Jan. 5, 2016. 10 pages.

*Primary Examiner* — Kenneth L Thompson
*Assistant Examiner* — Michael Wills, III
(74) *Attorney, Agent, or Firm* — Trevor G. Grove

(57) ABSTRACT

Packers may be inflated within the wellbore to engage and isolate a portion of the wellbore wall. Charges included within the packers may then be fired to perforate the formation. According to certain embodiments, the charges may be located within drains in the packers that can be subsequently employed to sample the surrounding formation.

15 Claims, 7 Drawing Sheets

(56) References Cited

U.S. PATENT DOCUMENTS

| | | | |
|---|---|---|---|
| 2009/0301635 | A1 | 12/2009 | Corre et al. |
| 2010/0071898 | A1 | 3/2010 | Corre et al. |
| 2010/0157737 | A1 | 6/2010 | Miller et al. |
| 2011/0107830 | A1 | 5/2011 | Fields et al. |
| 2011/0277999 | A1 | 11/2011 | Corre et al. |
| 2015/0176392 | A1 | 6/2015 | Corre |
| 2015/0176406 | A1 | 6/2015 | Corre et al. |

* cited by examiner

PERFORATING PACKER SAMPLING APPARATUS AND METHODS

BACKGROUND OF THE DISCLOSURE

Wellbores (also known as boreholes) are drilled to penetrate subterranean formations for hydrocarbon prospecting and production. During drilling operations, evaluations may be performed of the subterranean formation for various purposes, such as to locate hydrocarbon-producing formations and manage the production of hydrocarbons from these formations. To conduct formation evaluations, the drill string may include one or more drilling tools that test and/or sample the surrounding formation, or the drill string may be removed from the wellbore, and a wireline tool may be deployed into the wellbore to test and/or sample the formation. These drilling tools and wireline tools, as well as other wellbore tools conveyed on coiled tubing, drill pipe, casing or other conveyers, are also referred to herein as "downhole tools."

Formation evaluation may involve drawing fluid from the formation into a downhole tool for testing and/or sampling. Various devices, such as probes and/or packers, may be extended from the downhole tool to isolate a region of the wellbore wall, and thereby establish fluid communication with the subterranean formation surrounding the wellbore. To promote fluid communication for low permeability formations, the formation may be perforated prior to sampling.

SUMMARY

The present disclosure relates to a method that includes perforating a formation with a charge disposed in a packer engaged with a wellbore wall. The method further includes sampling a fluid from the formation through an inlet of the packer.

The present disclosure also relates to a method that includes inflating a packer to engage a wellbore wall and perforating the wellbore wall with one or more charges each disposed in a respective drain of the packer. The method further includes drawing fluid into the packer through the respective drains.

The present disclosure further relates to a packer system that includes an inner inflatable bladder disposed within an outer structural layer, a drain disposed in the outer structural layer and coupled to a flow tube extending through the packer, and a perforating charge disposed in the drain.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

It is to be understood that the present disclosure provides many different embodiments, or examples, for implementing different features of various embodiments. Specific examples of components and arrangements are described below to simplify the present disclosure. These are, of course, merely examples and are not intended to be limiting.

The present disclosure relates to packers that can be employed to perforate and sample a formation. According to certain embodiments, the packers may be conveyed within a wellbore on a wireline, drillstring, coiled tubing, or other suitable conveyance. The packers may be inflated within the wellbore to engage and isolate a portion of the wellbore wall. Charges included within the packers may then be fired to perforate the formation. According to certain embodiments, the charges may be located within drains in the packers that can be subsequently employed to sample the surrounding formation. In other embodiments, adjacent drains may be employed to sample the surrounding formation. The perforating packers also may be employed in cased wellbores to perforate and sample the formation to enhance production.

Figure 1:
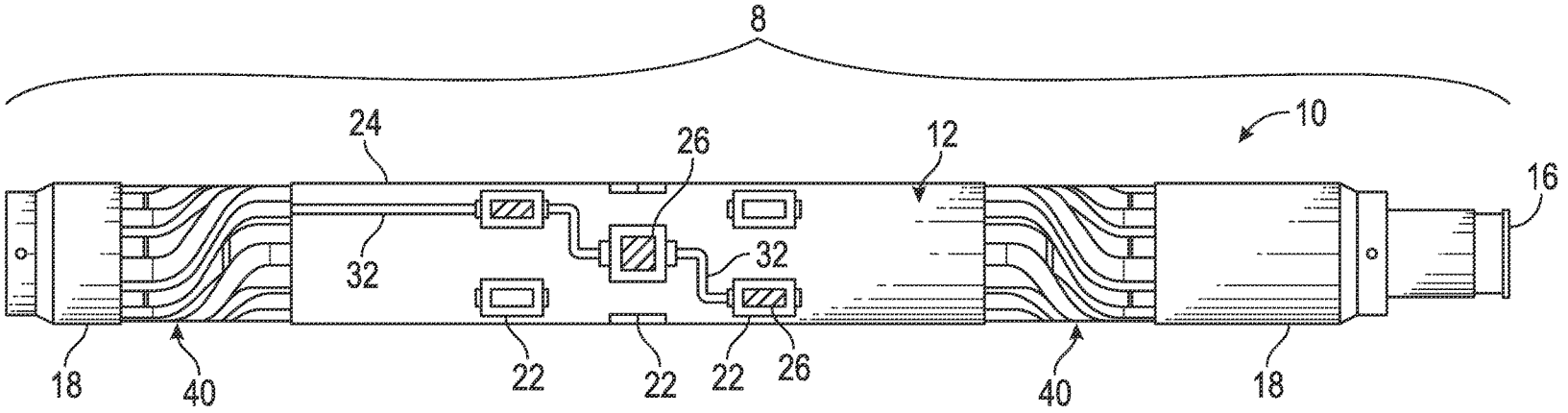
FIG. 1 is a front view of an embodiment of a perforating packer, according to aspects of the present disclosure.
Figure 2:
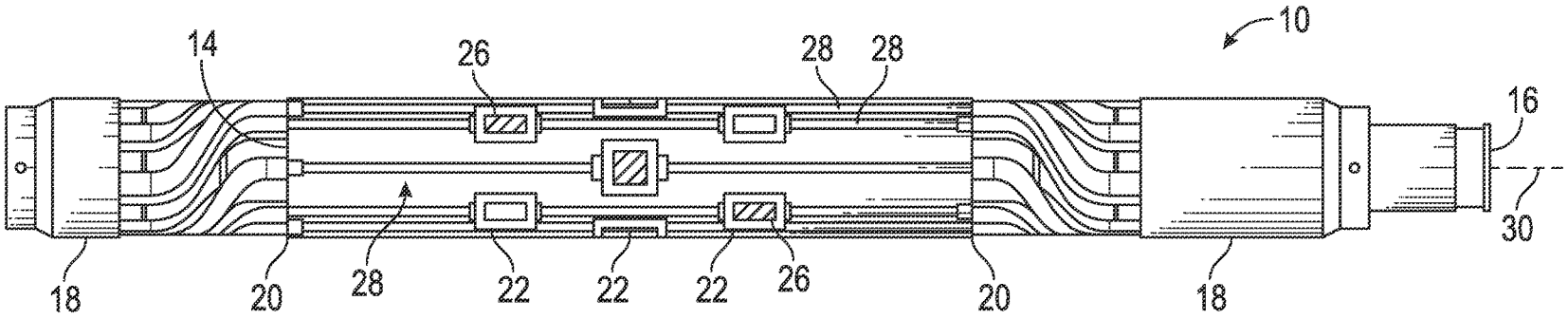
FIG. 2 is a front view of the embodiment of the perforating packer of FIG. 1 showing the internal components of an outer structural layer, according to aspects of the present disclosure.

FIGS. 1 through 4 depict an embodiment of a perforating packer 10 that can be employed to perforate and sample a formation. The packer is disposed in a packer module 8 that can be incorporated into a tool string as discussed further below. As shown in FIG. 1, the packer 10 includes an outer structural layer 12 that is expandable in a wellbore to form a seal with the surrounding wellbore wall or casing. Disposed within an interior of the outer structural layer 12 is an inner, inflatable bladder 14 disposed within an interior of the outer structural layer 12. For ease of illustration, FIG. 2 depicts the packer 10 with the outer portion of the outer structural layer 12 removed to show the internal components of the outer structural layer 12 and the inflatable bladder 14. The inflatable bladder 14 can be formed in several configurations and with a variety of materials, such as a rubber layer having internal cables. In one example, the inflatable bladder 14 is selectively expanded by fluid delivered via an inner mandrel 16. The packer 10 also includes a pair of mechanical fittings 18 that are mounted around the inner mandrel 16 and engaged with axial ends 20 of the outer structural layer 12.

The outer structural layer 12 includes one or more drains 22, or inlets, through which fluid may be drawn into the packer from the subterranean formation. Further, in certain embodiments, fluid also may be directed out of the packer 10 through the drains 22. The drains 22 may be embedded radially into a sealing element or seal layer 24 that surrounds the outer structural layer 12. By way of example, the seal layer 24 may be cylindrical and formed of an elastomeric material selected for hydrocarbon based applications, such as a rubber material. As shown in FIG. 2, tubes 28 may be operatively coupled to the drains 22 for directing the fluid in an axial direction to one or both of the mechanical fittings 18. The tubes 28 may be aligned generally parallel with a packer axis 30 that extends through the axial ends of outer structural layer 12. The tubes 28 may be at least partially embedded in the material of sealing element 24 and thus may move radially outward and radially inward during expansion and contraction of outer layer 12.

Perforating charges 26 may be mounted in one or more of the drains 22. According to certain embodiments, the perforating charges may be encapsulated shape charges, or other suitable charges. A detonating cord 32 may be disposed along the surface of the seal layer 24 and coupled to the charges 26 to fire the charges in response to stimuli, such as an electrical signal, a pressure pulse, an electromagnetic signal, or an acoustic signal among others. The detonating cord 32 may extend along the seal layer to one of the mechanical fittings 18. In other embodiments, rather than extending along the surface of the seal layer 24, the detonating cord 32 may be disposed within one or more of the tubes 28 and may be coupled to a perforating charge 26 through the interior of the respective drain 22. As shown in FIG. 1, perforating charges 26 are mounted in some of the drains 22, while other drains 22 do not include perforating charges. However, in other embodiments, perforating charges 26 may be mounted in each of the drains. Further, in other embodiments, the arrangement and number of drains 22 that include perforating charges 26 may vary. For example, in certain embodiments, radially alternating drains 22 may include perforating charges 26.

Figure 3:
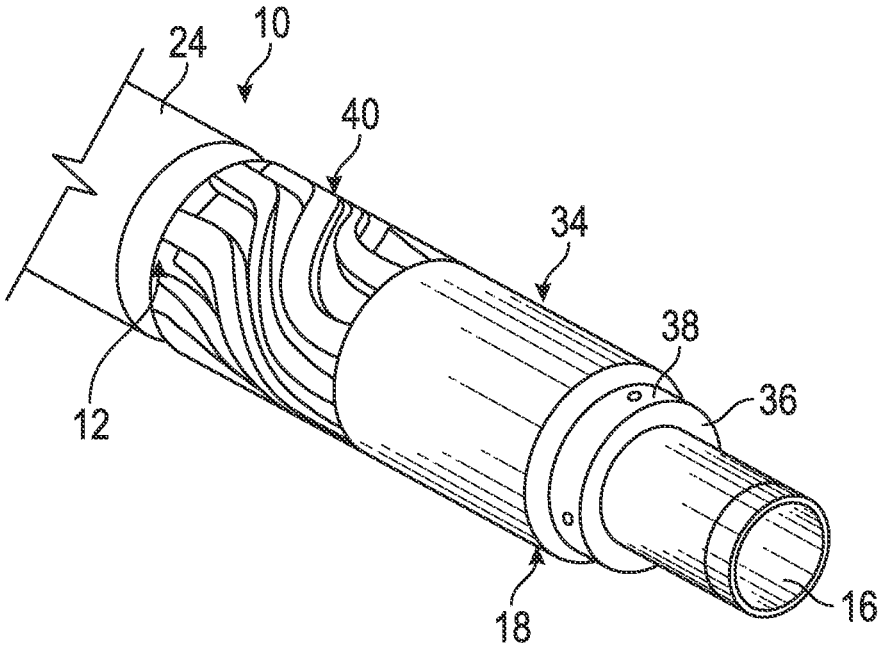
FIG. 3 is a perspective view of an end of the perforating packer of FIG. 1 in a contracted position, according to aspects of the present disclosure.
Figure 4:
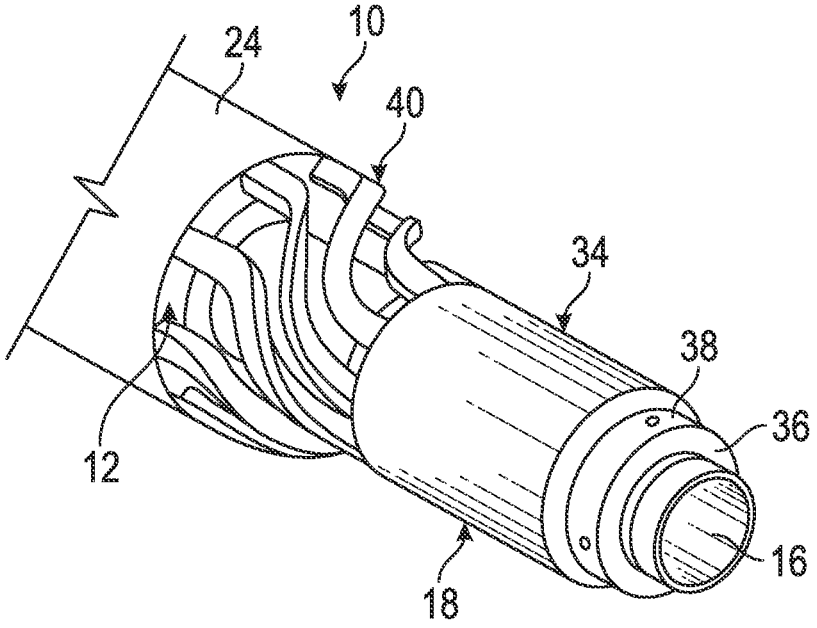
FIG. 4 is a perspective view of an end of the perforating packer of FIG. 1 in an expanded position, according to aspects of the present disclosure.

FIGS. 3 and 4 depict the mechanical fittings 18 in the contracted position (FIG. 3) and the expanded position (FIG. 4). Each mechanical fitting 18 includes a collector portion 34 having an inner sleeve 36 and an outer sleeve 38 that are sealed together. Each collector portion 34 can be ported to deliver fluid collected from the surrounding formation to a flowline within the downhole tool. One or more movable members 40 are movably coupled to each collector portion 34, and at least some of the movable members 40 are used to transfer collected fluid from the tubes 28 into the collector portion 34. By way of example, each movable member 40 may be pivotably coupled to its corresponding collector portion 34 for pivotable movement about an axis generally parallel with packer axis 30.

In the illustrated embodiment, multiple movable members 40 are pivotably mounted to each collector portion 34. The movable members 40 are designed as flow members that allow fluid flow between the tubes 28 and the collector portions 34. In particular, certain movable members 40 are coupled to certain tubes 28 extending to the drains 22, allowing fluid from the drains 22 to be routed to the collector portions 34. Further, in certain embodiments, the movable members 40 also may direct fluid from the collector portions 34 to the tubes 28 to be expelled from the packer 10 through the drains 22. The movable members 40 are generally S-shaped and designed for pivotable connection with both the corresponding collector portion 34 and the corresponding tubes 28. As a result, the movable members 40 can be pivoted between the contracted configuration illustrated in FIG. 3 and the expanded configuration illustrated in FIG. 4.

Figure 5:
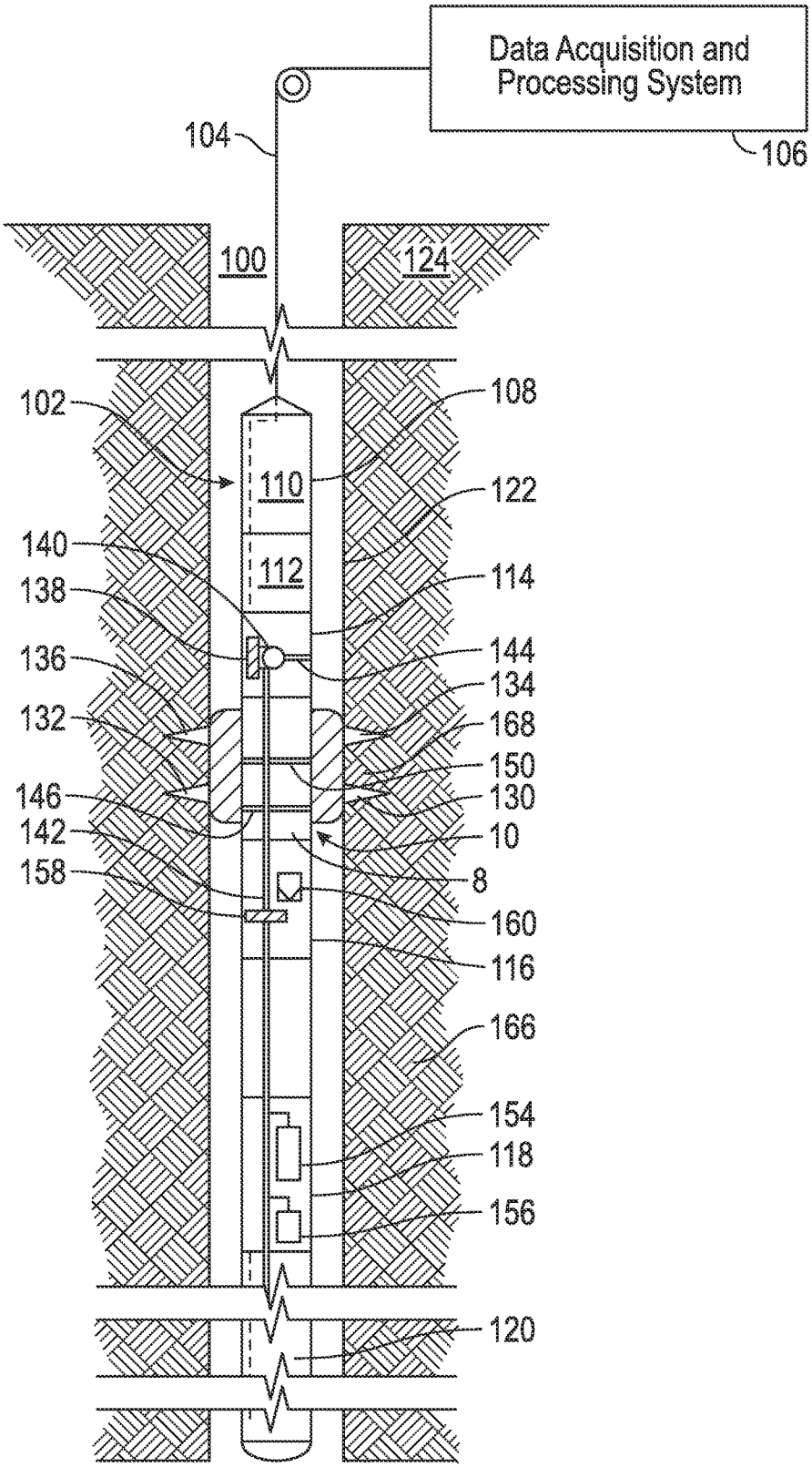
FIG. 5 is a schematic view of an embodiment of a wellsite system that may employ perforating packers, according to aspects of the present disclosure.

FIG. 5 depicts the packer 10 disposed within a wellbore 100 as part of a downhole tool 102. The downhole tool 102 is suspended in the wellbore 100 from the lower end of a multi-conductor cable 104 that is spooled on a winch at the surface. The cable 104 is communicatively coupled to a processing system 106. The downhole tool 102 includes an elongated body 108 that houses the packer module 8, as well as other modules 110, 112, 114, 116, 118, and 120 that provide various functionalities including fluid sampling, fluid testing, and operational control, among others. As shown in FIG. 1, the downhole tool 102 is conveyed on a wireline (e.g., using the multi-conductor cable 104); however, in other embodiments the downhole tool may be conveyed on a drill string, coiled tubing, wired drill pipe, or other suitable types of conveyance.

The wellbore 100 is positioned within a subterranean formation 124. As shown in FIG. 5, the packer is radially expanded to form a seal against the wellbore wall 122. As described further below with respect to FIG. 6, the perforating packer 10 can be used to perforate the wellbore wall 122 and subterranean formation 124 to form perforations 130, 132, 134, and 136. The packer 10 can also be used to sample fluid from the formation by withdrawing fluid into the drains 22 (FIG. 1) through the perforations 130, 132, 134, and 136, as described further below with respect to FIG. 6.

In addition to the packer 10, the downhole tool 102 includes the firing head 112 for igniting the charges 26 included within the packer. For example, the firing head 112 may respond to stimuli communicated from the surface of the well for purposes of initiating the firing of perforating charges 26. More specifically, the stimuli may be in the form of an annulus pressure, a tubing pressure, an electrical signal, pressure pulses, an electromagnetic signal, an acoustic signal. Regardless of its particular form, the stimuli may be communicated downhole and detected by the firing head 112 for purposes of causing the firing head 112 to ignite the perforating charges 26. As an example, in response to a detected fire command, the firing head 112 may initiate a detonation wave on the detonating cord 32 (FIG. 1) for purposes of firing the perforating charges 26.

The downhole tool 102 also includes the pump out module 114, which includes a pump 138 designed to provide motive force to direct fluid through the downhole tool 102. According to certain embodiments, the pump 138 may be a hydraulic displacement unit that receives fluid into alternating pump chambers and provides bi-directional pumping. A valve block 140 may direct the fluid into and out of the alternating pump chambers. The valve block 140 also may direct the fluid exiting the pump 138 through a primary flowline 142 that extends through the downhole tool 102 or may divert the fluid to the wellbore through a wellbore flowline 144. Further, the pump 138 may draw fluid from the wellbore into the downhole tool 102 through the wellbore flowline 144, and the valve block 140 may direct the fluid from the wellbore flowline 144 to the primary flowline 142. Further, fluid may be directed from the primary flowline 142 through an inflation line 146 to inflate the bladder 14 (FIG. 2), expanding the packers 10 into engagement with the wellbore wall 122. Fluid also may be directed from the primary flowline 142 through flowline 150 and into the movable members 40 (FIG. 1) and tubes 28 to inject fluid into the subterranean formation 124 through the drains 22 and perforations 130, 132, 134, and 136 to treat the subterranean formation 124. Moreover, fluid may be drawn into the downhole tool 102 through the perforations 130, 132, 134, and 136, drains 22, and tubes 28, moveable members 40 and flowline 150 to sample fluid from the subterranean formation 124.

The downhole tool 102 further includes the sample module 118 which has storage chambers 154 and 156. According to certain embodiments, the storage chambers 154 may store fluid, such as a treatment fluid, that can be injected into the subterranean formation 124 through the drains 22 and perforations 130, 132, 134, and 136 to treat the subterranean formation 124. Further, the storage chamber 156 may function as a sample chamber that stores a sample of formation fluid that is drawn into the downhole tool 102 through the drains 22 and perforations 130, 132, 134, and 136. As shown in FIG. 5, two storage chambers 154 and 156 are included within the sample module 118. However, in other embodiments, any number of storage chambers may be included within the sample module 118, for example to provide for storage of multiple formation fluid samples. Further, in other embodiments, multiple sample modules 118 may be included within the downhole tool 102. Moreover, other types of sample chambers, such as single phase sample bottles, among others, may be employed in the sample module 118.

The downhole tool 102 also includes the fluid analysis module 116 that has a fluid analyzer 158, which can be employed to measure properties of fluid flowing through the downhole tool 102. For example, the fluid analyzer 158 may include an optical spectrometer and/or a gas analyzer designed to measure properties such as, optical density, fluid density, fluid viscosity, fluid fluorescence, fluid composition, oil based mud (OBM) level, and the fluid gas oil ratio (GOR), among others. One or more additional measurement devices, such as temperature sensors, pressure sensors, resistivity sensors, chemical sensors (e.g., for measuring pH or $H_2S$ levels), and gas chromatographs, may also be included within the fluid analyzer 158. In certain embodiments, the fluid analysis module 116 may include a controller 160, such as a microprocessor or control circuitry, designed to calculate certain fluid properties based on the sensor measurements. Further, in certain embodiments, the controller 116 may govern the perforating and sampling operations. Moreover, in other embodiments, the controller 116 may be disposed within another module of the downhole tool 102.

The downhole tool 102 also includes the telemetry module 110 that transmits data and control signals between the processing system 106 and the downhole tool 102 via the cable 104. Further, the downhole tool 102 includes the power module 120 that converts AC electrical power from surface to DC power. Further, in other embodiments, additional modules may be included in the downhole tool 200 to provide further functionality, such as resistivity measurements, hydraulic power, coring capabilities, and/or imaging, among others. Moreover, the relative positions of the modules 110, 112, 114, 116, 118, and 120 may vary.

Figure 6:
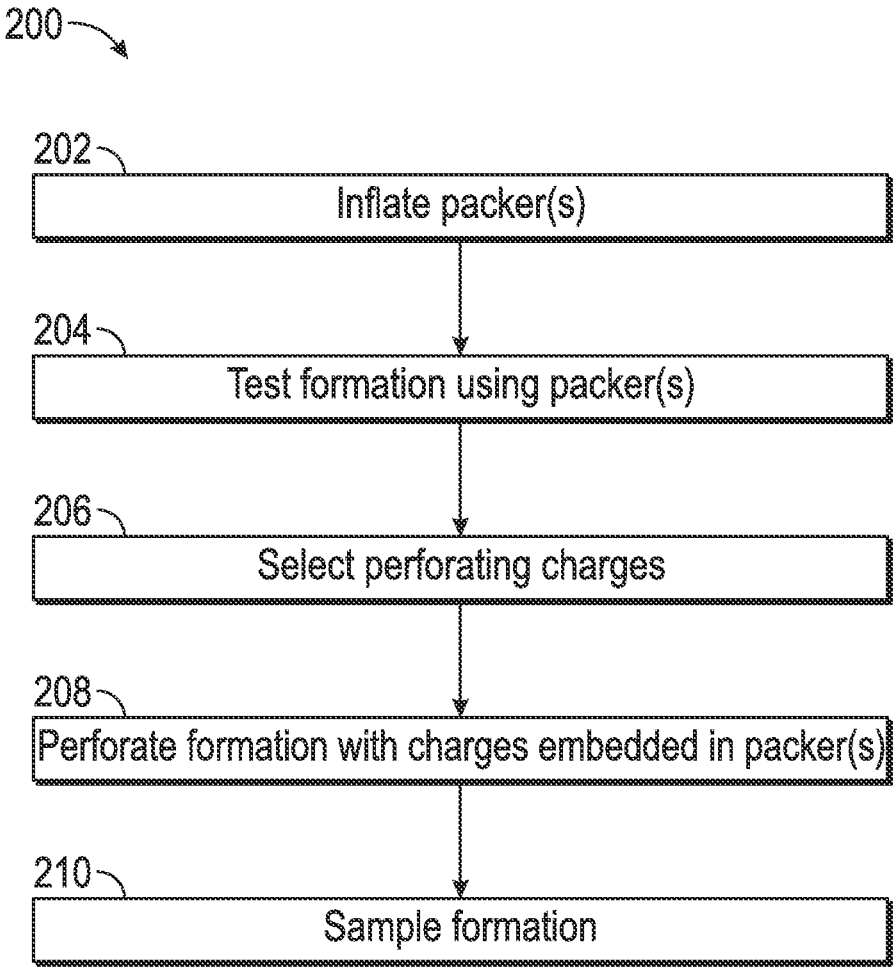
FIG. 6 is a flowchart depicting an embodiment of a method for perforating and sampling, according to aspects of the present disclosure.

FIG. 6 is a flowchart depicting an embodiment of a method 200 that may be employed to perforate and sample a subterranean formation. According to certain embodiments, the method 200 may be executed, in whole or in part, by the controller 160 (FIG. 5). For example, the controller 160 may execute code stored within circuitry of the controller 160, or within a separate memory or other tangible readable medium, to perform the method 200. Further, in certain embodiments, the controller 160 may operate in conjunction with a surface controller, such as the processing system 106 (FIG. 5), that may perform one or more operations of the method 200.

The method may begin by inflating (block 202) the packer. For example, as shown in FIG. 5, the downhole tool 102 may be conveyed to a desired location within the wellbore 100, and the packer 10 may be expanded to engage the wellbore wall 122. In certain embodiments, fluid may be directed into the packer 10 through the inflation flowline 146 to expand the inflatable bladder 14 (FIG. 2) and place the packer 10 in engagement with the wellbore. As shown in FIG. 5, a single packer 10 is inflated; however, in other embodiments, any number of packers may be included within the downhole tool 102 and employed to perform perforating and sampling.

After the packer 10 has been inflated, the packer 10 may be used to test (block 204) the formation to determine formation properties. For example, one or more of the drains 22 (FIG. 1) that do not contain perforating charges 26 may be employed to measure formation pressures, for example, using formation pressure techniques known to those skilled in the art. In certain embodiments, the pump 138 may be operated to withdraw fluid from the formation 124 into the drains 22 and the pressure response may be measured to determine the formation anisotropy and/or permeability. In other embodiments, the pump 138 may be operated to inject fluid into the formation 124 through the drains 22 and the pressure response may be measured to determine the formation anisotropy and/or permeability. According to certain embodiments, fluid may be withdrawn into the drains 22, or injected from the drains 22, in a sequential manner allowing the pressure response from each drain 22 to be measured and compared to determine the formation anisotropy.

The formation properties may then be employed to select (block 206) perforating charges that should be fired. For example, several drains 22 in disposed in different radial and vertical locations on the packer 10 may include perforating charges 26 and certain of these charges may be selected based on the anisotropy and/or permeability of the formation. In certain embodiments, a greater number of charges may be fired for relatively low permeability formations. The perforations may promote fluid flow within tight formations and decrease subsequent sampling time. Further, in certain embodiments, charges 26 may be fired in certain radial directions based on the horizontal anisotropy of the formation. Moreover, charges 26 may be fired at certain depths within the wellbore based on the vertical anisotropy of the formation.

The formation may then be perforated (block 208) using the selected charges embedded in the packers. For example, the firing head 112 (FIG. 5) may initiate a detonation wave on the detonating cords 32 (FIG. 1) to ignite the charges 26 disposed within the drains 22 of the packer 10. In certain embodiments, separate detonating cords 32 may be run to individual charges 26 or to separate groups of charges 26, and detonation waves may be initiated on the detonating cords 32 coupled to the selected charges 26. Upon ignition, the charges 26 may form the perforations 130, 132, 134, and 136. In certain embodiments, the packer 10 may be further inflated during perforating, allowing vibrations produced by firing the charges 26 to be absorbed by the packer 10. Further, the packer may be inflated to apply stress to the formation to improve the perforating efficiency. Although FIG. 5 depicts four perforations 130 and 132 or 134 and 136, in other embodiments, any number of one or more perforations may be produced using the packer 10. Further, in certain embodiments, blocks 204 and 206 may be omitted and all of the charges 26 included within the packer 10 may be fired to perforate the formation 124.

After the casing has been perforated, the formation be sampled (block 210) using the packer 10. For example, as shown in FIG. 5, the pump 138 may be employed to draw fluid out of the formation 124 through the perforations 130, 132, 134, and 136 and into the drains 22. The formation fluid may flow through the drains 22 to the tubes 28 and the movable members 40, which may direct the fluid through the flowline 150 to the primary flowline 142. The pump 138 may draw the fluid through the primary flowline 142 to the fluid analyzer 158 to determine properties of the fluid. Once the fluid exhibits desired properties, such as low contamination (e.g., a contamination level within a desired range), for example, the fluid may be routed to the sample chamber 156 where the fluid may be stored for retrieval to the surface.

According to certain embodiments, the fluid may enter the packer 10 through the same drains 22 that included the fired perforating charges 26. However, in other embodiments, the fluid may enter the packer 10 through proximate drains 22 that did not include the perforating charges 26. In certain embodiments, the contact of the packer with the formation after perforating may inhibit mud invasion, resulting in a reduced cleanup time (e.g., a shorter time to obtaining a low contamination level in the formation fluid). Further, the use of the same drains 22 for perforating and sampling may create direct communication between the sampling drains 22 and the non-invaded formation fluid, resulting in a reduced cleanup time.

Figure 7:
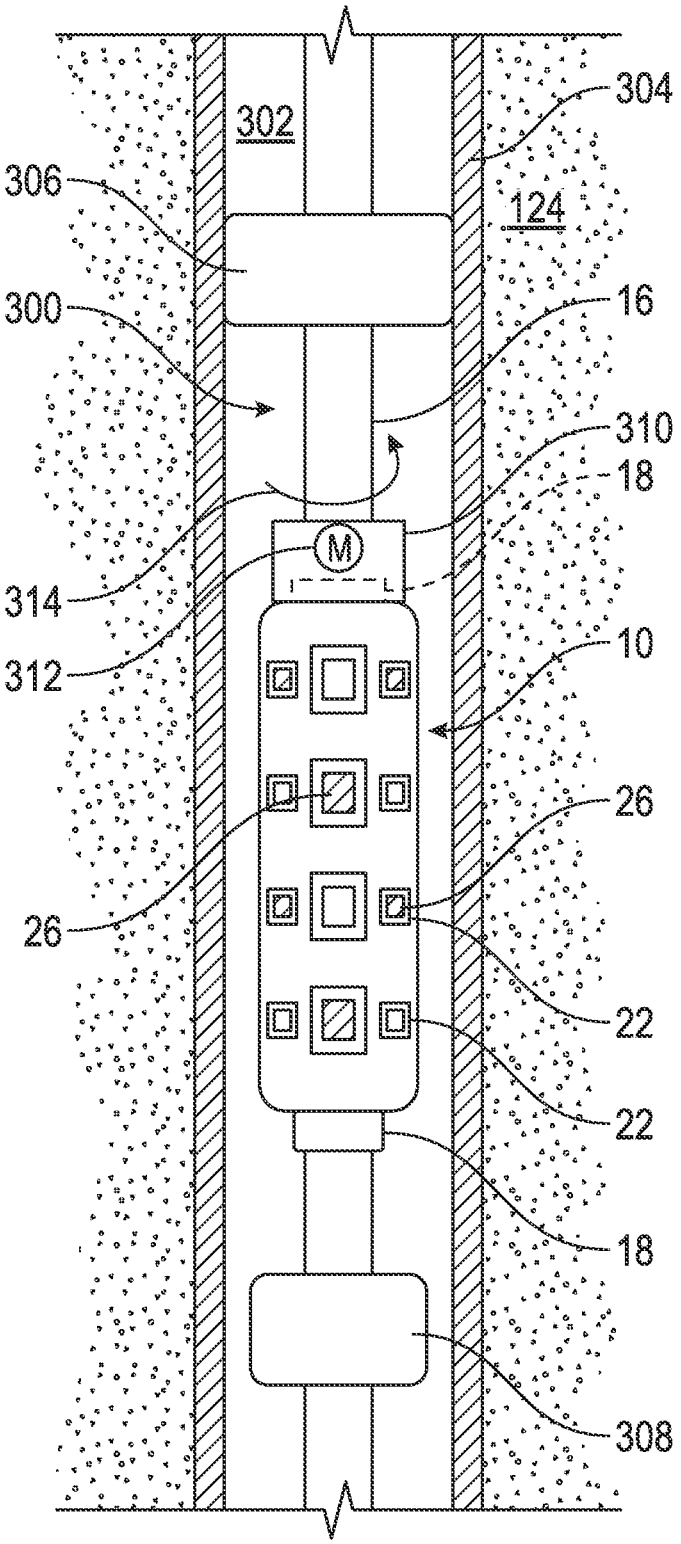
FIG. 7 is a schematic view of the perforating packer of FIG. 1 disposed within a cased wellbore in the contracted position.
Figure 8:
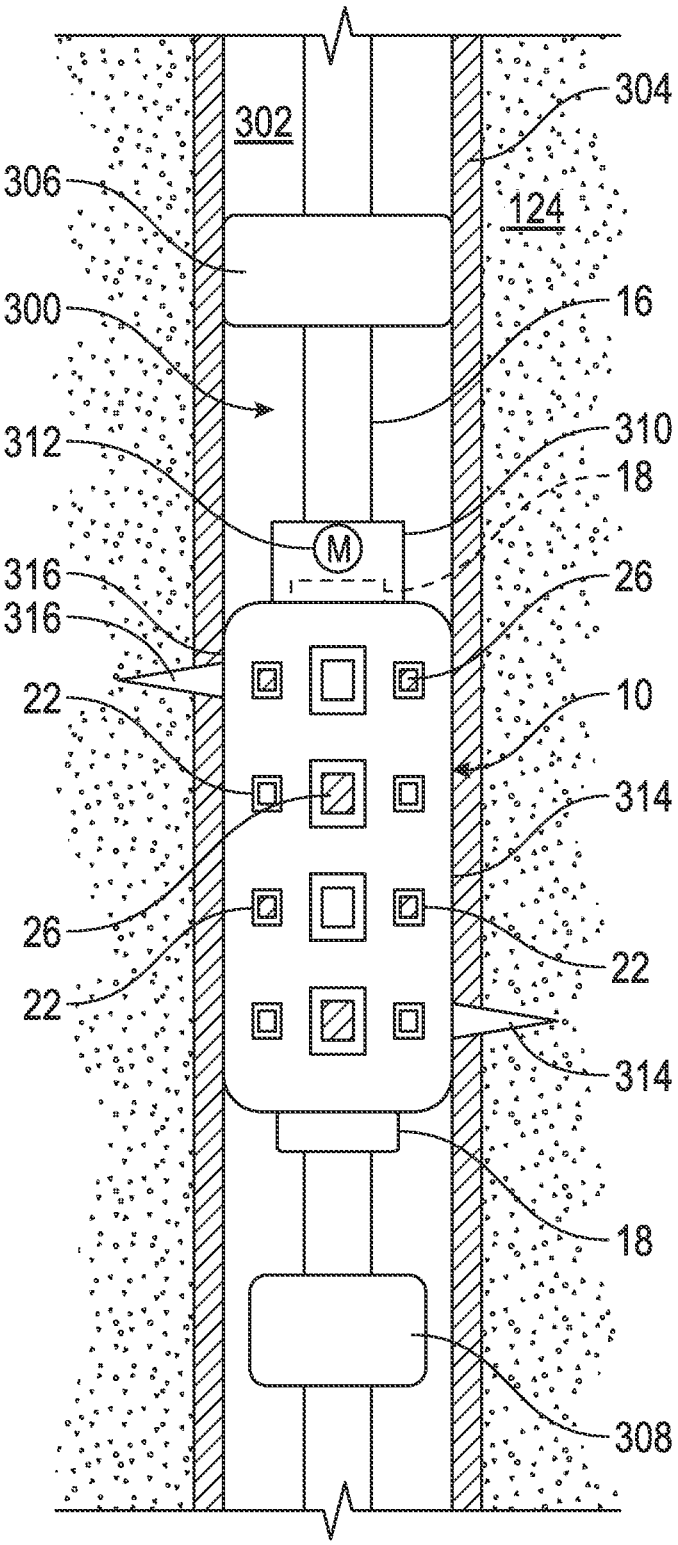
FIG. 8 is a schematic view of the perforating packer of FIG. 1 disposed within a cased wellbore in the expanded position.
Figure 9:
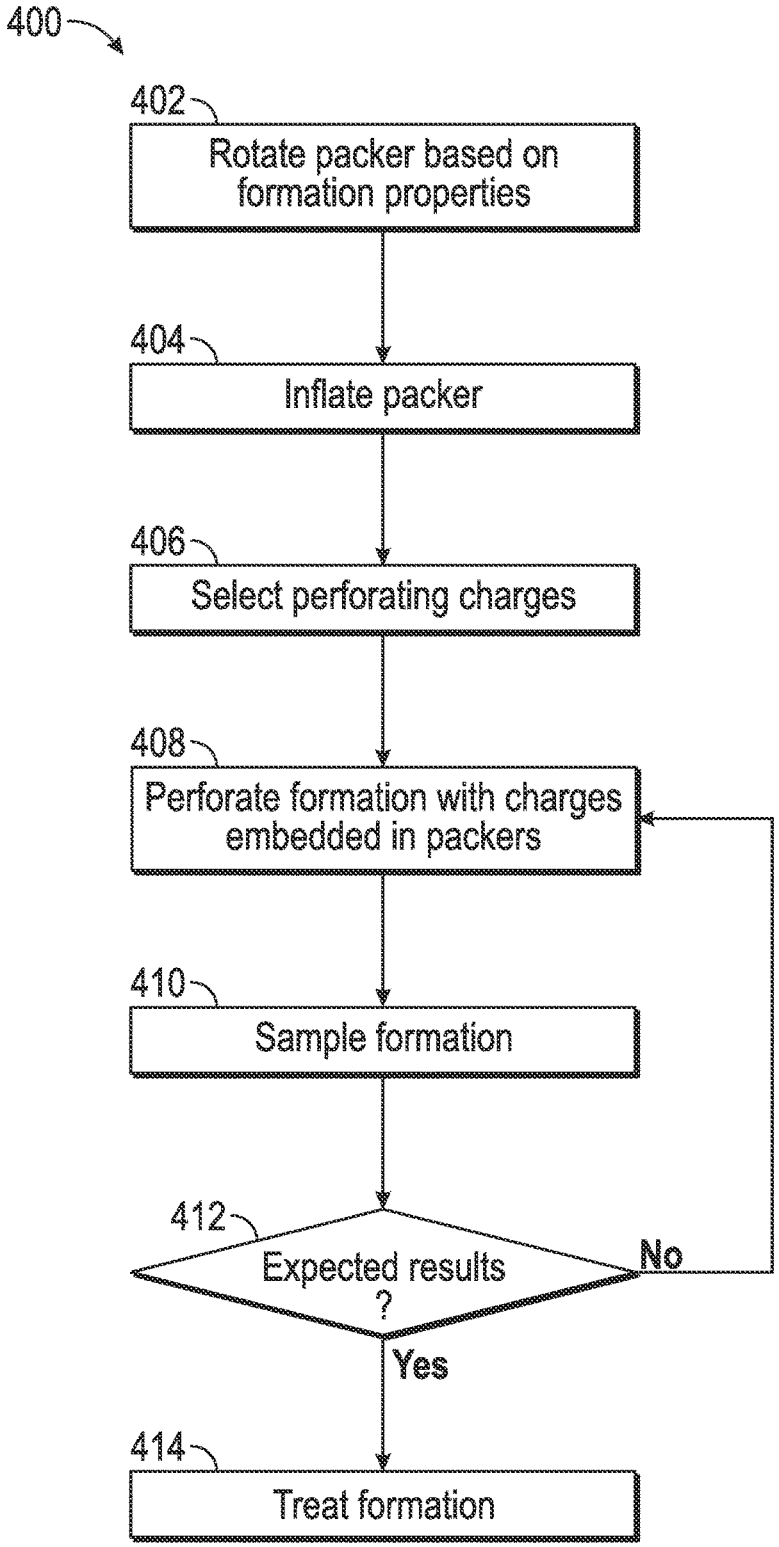
FIG. 9 is a flowchart depicting another embodiment of a method for perforating and sampling, according to aspects of the present disclosure.

FIGS. 7 and 8 depict another embodiment of a packer module 300 that can be employed for perforating and sampling. The packer module 300 may be disposed within a wellbore 302 as part of a downhole tool and may be coupled together with other modules, such as the telemetry module 110, the firing head 112, the pump out module 114, the fluid analysis module 116, the sample module 118, and the power module 120, described above with respect to FIG. 5. The wellbore 302 is positioned within a subterranean formation 124 and includes a casing 304. The packer module 300 includes the packer 10, which has the structure and features described above with respect to FIGS. 1-4. For ease of illustration, the movable members 40 are not shown in FIGS. 7 and 8; however, the packer 10 included within the packer module 300 includes the movable members 40, the tubes 28, the drains 22, the perforating charges 26, and the mechanical fittings 18, as well as the other features described above with respect to FIGS. 1-4.

The packer module 300 includes a pair of standoffs 306 and 308 disposed above and below the packer 10. According to certain embodiments, the standoffs 306 and 308 may function to centralize the packer module 300 within the wellbore and may provide structural support. The standoff 306 can be extended to anchor the packer module 300 to the casing 304, as shown in FIGS. 7 and 8. According to certain embodiments, the standoff 306 may be an inflatable packer or mechanical anchoring device, among others. The packer module 300 also includes a rotation joint 310 that allows the packer 10 to rotate radially within the wellbore 302, as shown by the arrow 314. The rotation joint 310 includes a motor 312 that governs rotation of the packer 10. FIG. 7 depicts the packer 10 in the contracted position where the packer 10 is disengaged from the casing 304 and able to rotate radially within the wellbore 302. FIG. 8 depicts the packer 10 in the expanded position where the packer 10 is expanded to engage the casing 304.

FIG. 8 depicts a method 400 that may be employed to perforate and sample a subterranean formation using the packer module 300. The method may begin by rotating (block 402) the packer 10 based on formation properties. For example, the packer 10 may be rotated radially within the wellbore 302 using the motor 312 to align the packer 10 with radial sections of the casing 304 and surrounding formation 124 selected based on formation properties, such as anisotropy and/or permeability, that can be employed to increase production. According to certain embodiments, the formation properties may be determined by testing and sampling the wellbore 302 prior to installing the casing 304, for example using formation pressure testing and sampling techniques known to those skilled in the art.

After the packer 10 is radially positioned within the wellbore 302, the packer 10 may be inflated (block 404). For example, the pump 138 (FIG. 5) may be operated to direct fluid into the packer 10 to expand the inflatable bladder 14 (FIG. 2) and place the packer 10 in engagement with the casing. As shown in FIG. 8, a single packer 10 is inflated; however, in other embodiments, any number of packers may be employed to perform perforating and sampling. The formation properties may then be employed to select (block 406) perforating charges that should be fired. For example, several drains 22 in disposed in different radial and vertical locations on the packer 10 may include perforating charges 26 and certain of these charges may be selected based on the anisotropy and/or permeability of the formation.

The formation may then be perforated (block 408) using the selected charges embedded in the packers. For example, the firing head 112 (FIG. 5) may initiate a detonation wave on the detonating cords 32 (FIG. 1) to ignite the charges 26 disposed within the drains 22 of the packer 10. In certain embodiments, separate detonating cords 32 may be run to individual charges 26 or to separate groups of charges 26, and detonation waves may be initiated on the detonating cords 32 coupled to the selected charges 26. Upon ignition, the charges 26 may perforate the casing 304 to form perforations 314 and 316 that extend through the casing 304 into the formation 124. Although FIG. 8 depicts two perforations 314 and 36 in other embodiments, any number of one or more perforations may be included within each zone 162 and 164. Further, in other embodiments, block 406 may be omitted and all of the charges 26 included within the packer 10 may be fired to perforate the casing 304

After the casing has been perforated, the formation be sampled (block 410) using the packer 10. For example, the pump 138 (FIG. 5) may be employed to draw fluid out of the formation 124 and into the drains 22 through the perforations formed in the casing. According to certain embodiments, the fluid may enter the packer 10 through the same drains 22 that included the fired perforating charges 26. However, in other embodiments, the fluid may enter the packer 10 through proximate drains 22 that did not include the perforating charges 26. The formation fluid may flow through the drains 22 to the tubes 28 and the movable members 40, which may direct the fluid through the flowline 150 to the primary flowline 142. The pump 138 may draw the fluid through the primary flowline 142 to the fluid analyzer 158 to determine production properties of the fluid, such as the pressure and flow rate, among others.

The method may then continue by determining (block 412) whether the results of the perforating and sampling are as expected. For example, the controller 106 and/or the controller 160 may execute code or other algorithms to determine if the production properties fall within a desired range, for example, to meet a target production level. If the results are not as expected, additional charges 26 within the packer 10 may be fired to form additional perforations within the casing 304. Further, in certain embodiments, the packer 10 may be retracted, allowing the packer to be radially rotated, and/or moved vertically within the wellbore 302. After repositioning the packer 10, additional charges 26 may be fired to form additional perforations within the casing 304.

If the results are as expected, the method may continue by treating (block 414) the formation using the packer 10 to stimulate production. For example, a treatment fluid may be injected into the formation 124 through the perforations 314 and 316. In certain embodiments, a treatment fluid may be stored within a storage chamber 154 (FIG. 5) and pumped to the packer 10 using the pump 138. The pump 138 may direct the treatment fluid through the primary flowline 142 and the flowlines 150 and 152 to the movable members 40 (FIG. 1). The treatment fluid may then flow through the tubes 28 and the drains 22 into the formation 124 through the perforations 314 and 316. In other embodiments, the treatment process may be omitted or performed using a separate downhole tool or module.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A method comprising:

perforating a formation with a charge disposed in a packer engaged with a wellbore wall; and sampling a fluid from the formation through an inlet of the packer;

testing the formation using another inlet of the packer to determine a formation property.

2. The method of claim 1, wherein the charge is disposed in the inlet.

3. The method of claim 1, wherein perforating comprises initiating a detonating wave on a detonating cord disposed on an outer surface of the packer.

4. The method of claim 1, wherein perforating comprises initiating a detonating wave on a detonating cord disposed within a fluid tube of the packer.

5. The method of claim 1, comprising selecting the charge from a plurality of charges disposed in the packer based on the determined formation property.

6. The method of claim 1, wherein sampling the fluid comprising pumping the fluid into the inlet of the packer and storing the fluid within a sample chamber of a downhole tool.

7. A method comprising:

inflating a packer to engage a wellbore wall;

perforating the wellbore wall with one or more charges each disposed in a respective drain of the packer;

drawing fluid into the packer through the respective drains; and rotating the packer to a radial position within the wellbore selected based on formation properties.

8. The method of claim 7, wherein inflating the packer comprises directing a wellbore fluid into an inflatable bladders of the packer.

9. The method of claim 7, wherein the wellbore wall comprises a casing.

10. The method of claim 7, comprising sampling formation fluid through the respective drains subsequent to the perforating to determine production properties.

11. The method of claim 7, comprising injecting a treatment fluid into the formation through the respective drains subsequent to the perforating.

12. A method comprising:

inflating a packer to engage a wellbore wall;

perforating the wellbore wall with one or more charges each disposed in a respective drain of the packer;

drawing fluid into the packer through the respective drains;

sampling formation fluid through the respective drains subsequent to the perforating to determine production properties; and determining whether the production properties correspond to expected results and perforating the wellbore wall with one or more additional charges each disposed in a respective additional drain of the packer in response to determining that the production properties do not correspond to the expected results.

13. The method of claim 12, wherein inflating the packer comprises directing a wellbore fluid into an inflatable bladders of the packer.

14. The method of claim 12, wherein the wellbore wall comprises a casing.

15. The method of claim 12, comprising injecting a treatment fluid into the formation through the respective drains subsequent to the perforating.

* * * * *